US009926723B2

(12) United States Patent
Mackle

(10) Patent No.: US 9,926,723 B2
(45) Date of Patent: Mar. 27, 2018

(54) LOCKING MECHANISM

(71) Applicant: Trevor Mackle, Hornsby (AU)

(72) Inventor: Trevor Mackle, Hornsby (AU)

( * ) Notice: Subject to any disclaimer, the term of this patent is extended or adjusted under 35 U.S.C. 154(b) by 245 days.

(21) Appl. No.: 14/982,829

(22) Filed: Dec. 29, 2015

(65) Prior Publication Data

US 2016/0130838 A1 May 12, 2016

Related U.S. Application Data

(63) Continuation of application No. 13/805,968, filed as application No. PCT/AU2011/000652 on May 31, 2011, now Pat. No. 9,222,280.

(30) Foreign Application Priority Data

Jun. 23, 2010 (AU) ..... 2010902758
Aug. 30, 2010 (AU) ..... 2010903863

(51) Int. Cl.

| | |
|---|---|
| ***E05C 19/00*** | (2006.01) |
| ***E05B 15/02*** | (2006.01) |
| ***E05B 47/06*** | (2006.01) |
| ***E05B 47/00*** | (2006.01) |

(52) U.S. Cl.

CPC ..... *E05B 15/0205* (2013.01); *E05B 47/0047* (2013.01); *E05B 47/0607* (2013.01); *E05C 19/009* (2013.01); *Y10T 292/696* (2015.04); *Y10T 292/699* (2015.04)

(58) Field of Classification Search

None

See application file for complete search history.

(56) References Cited

U.S. PATENT DOCUMENTS

| | | | |
|---|---|---|---|
| 3,405,569 | A | 10/1968 | Norman |
| 3,525,242 | A | 8/1970 | Young |
| 4,901,544 | A | 2/1990 | Jang |
| 5,141,355 | A | 8/1992 | Stillwagon |
| 5,186,516 | A | 2/1993 | Alexander et al. |
| 8,720,874 | B2 | 5/2014 | Tschida et al. |
| 2007/0145821 | A1 | 6/2007 | Mekky et al. |
| 2009/0235767 | A1 | 9/2009 | Gameau et al. |

OTHER PUBLICATIONS

International Search Report; Australian Patent Office; International Application No. PCT/AU2011/000652; dated Jul. 15, 2011; 4 pages.

*Primary Examiner* — Alyson M Merlino

(74) *Attorney, Agent, or Firm* — Taft Stettinius & Hollister LLP

(57) ABSTRACT

A locking mechanism including a plunger, a plurality of locking elements, a cage including apertures in which the locking elements are housed, and a sleeve, with the sleeve moveable with respect to the cage between an unlocked position and a locked position, and when the sleeve is in the locked position, the sleeve maintains the locking elements in engagement with a recess on the plunger to restrict movement of the plunger.

17 Claims, 13 Drawing Sheets

LOCKING MECHANISM

CROSS REFERENCE TO RELATED APPLICATIONS

This application is a continuation of U.S. patent application Ser. No. 13/805,968 filed Dec. 20, 2012 and issuing as U.S. Pat. No. 9,222,280, which is a U.S. national stage application of International Application No. PCT/AU2011/000652 filed May 31, 2011, which claims priority to Australian Patent Application No. 2010-902758 filed Jun. 23, 2010 and Australian Patent Application No. 2010-903863 filed Aug. 30, 2010, the contents of each application hereby incorporated herein by reference in its entirety.

TECHNICAL FIELD

The present invention relates to locking mechanisms for use in electric locking devices. The invention more particularly relates to a locking mechanism with an improved pre-load function.

BACKGROUND

Electric locking devices such as electric strikes, for example, are typically used as components in electronic locking systems to provide security access control in buildings or the like. They are fitted to a door jamb, usually in association with a mechanical lock. The strike includes a pivotally moveable keeper which retains the door latch of the mechanical lock. When the strike is in an unlocked condition, the keeper is free to rotate and release the door latch of the mechanical lock so the door may be pushed open. When the strike is in a locked condition, the keeper is not free to rotate and the door can only be opened by withdrawing the door latch manually.

The strike can be controlled by way of a card reader, or another access control system, located on the outside of the door. Typically, no handle is provided on the outside of the door, and a rotatable handle is provided on the inside of the door. Therefore, from the inside, persons may operate the handle to leave the building or area. From the outside, persons may only enter if they activate the access control system to release the electric strike from its locked condition.

Electric locking devices such as electric strikes are often subjected to a condition known as "pre-load". Pre-load is the name given to lateral forces applied to the keeper. These lateral forces may be caused, for example, by warpage of a door or door frame, a person pushing on the door, or differences in air pressure on either side of the door such as might be caused by air conditioning or building ventilation systems.

If an electric strike is subjected to pre-load, this can affect correct operation of the strike. For instance, when under pre-load, the mechanism of the strike may become jammed and be unable to transition from a locked condition to an unlocked condition. As well as being unsatisfactory and inconvenient, this situation also raises serious safety concerns. In the event of an emergency or the like, a central control system may send a signal to the strike to adopt the unlocked condition. If the lock becomes jammed due to pre-load, then there is a risk that persons may be trapped behind doors, or that emergency workers cannot gain access through doors from the outside.

There remains a need to provide for electric locking devices with improved pre-load capabilities.

SUMMARY

A first aspect of the present invention provides a locking mechanism including a plunger; a plurality of locking elements; a cage including apertures in which the locking elements are housed; and a sleeve; wherein the sleeve is moveable with respect to the cage between an unlocked position and a locked position; and wherein in the locked position, the sleeve maintains the locking elements in engagement with a recess on the plunger to restrict movement of the plunger.

The locking elements may be generally spherical.

The sleeve may be moved between its unlocked and locked positions by rotating the sleeve.

The sleeve may include a threaded portion and whereby rotation of the sleeve causes movement along its thread.

The plunger may be biased towards an extended position by way of a spring.

A second aspect of the present invention provides an electric locking device including the locking mechanism.

The sleeve may be driven by a motor and gearbox.

The electric locking device may further include an onboard power source arranged to provide power to move the sleeve to its unlocked position in the event of power being cut to the electric strike.

The locking device may be an electric strike and further comprises: a keeper; and a housing; wherein the keeper is pivotally mounted in the housing and is moveable between a closed position and an open position; wherein the plunger cooperates with a formation on the keeper which is arranged to move the plunger when the keeper moves from the closed position to the open position.

A third aspect of the present invention provides a locking device arranged to be powered by an external power supply and including: an electric power storage means; and wherein the power storage means is arranged to operate the lock in the event of disconnection or failure of the external power supply to move the lock from a locked condition to an unlocked condition.

BRIEF DESCRIPTION OF THE DRAWINGS

An embodiment of the present invention will now be described, by way of example only, with reference to the accompanying drawings, in which.

DETAILED DESCRIPTION

Figure 1:
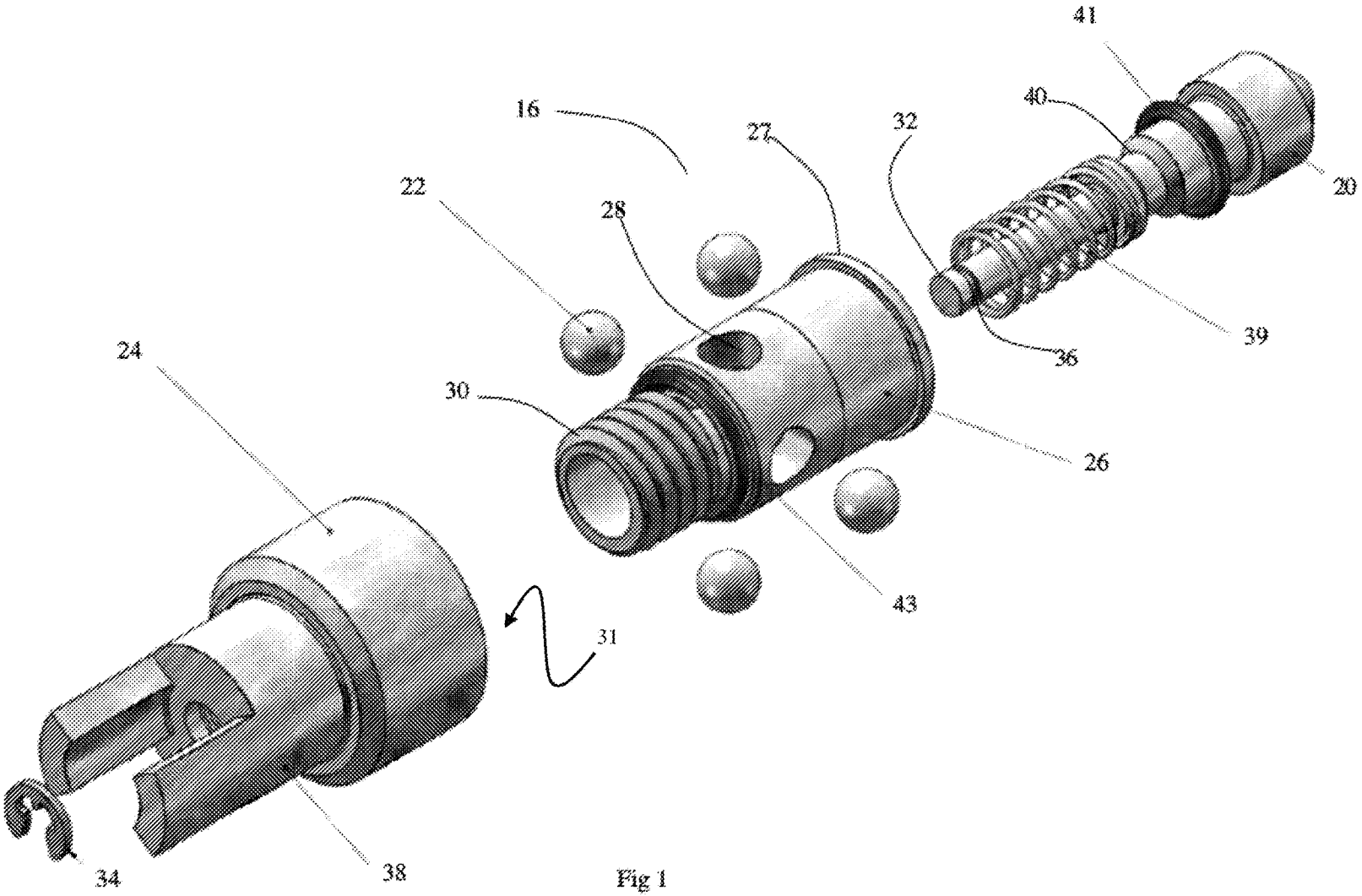
FIG. 1 is an exploded perspective view of a locking mechanism according to an embodiment of the invention.

Referring to FIG. 1, a locking mechanism 16 is shown in exploded detail and includes a plunger 20, four locking elements in the form of spherical balls 22, a sleeve 24, and a cage 26 which retains balls 22 in apertures 28. Cage 26 includes a mounting flange 27 and bears an external screw thread 30 which engages with an internal screw thread 31 provided inside sleeve 24. Sleeve 24 includes a dog 38 which is used to rotate the sleeve, as will be later described. Plunger 20 includes a tail which is inserted through both cage 30 and sleeve 24 and is secured by way of circlip 34 which engages with groove 36 on tail 32. Plunger 20 can move against the biasing force of compression spring 39 if the sleeve is in a position wherein balls 22 are free to move out of engagement of recess 40 of plunger, as will be later described. Rubber "O" rings 41, 43 keep dust or other debris from entering the mechanism.

Figure 2:
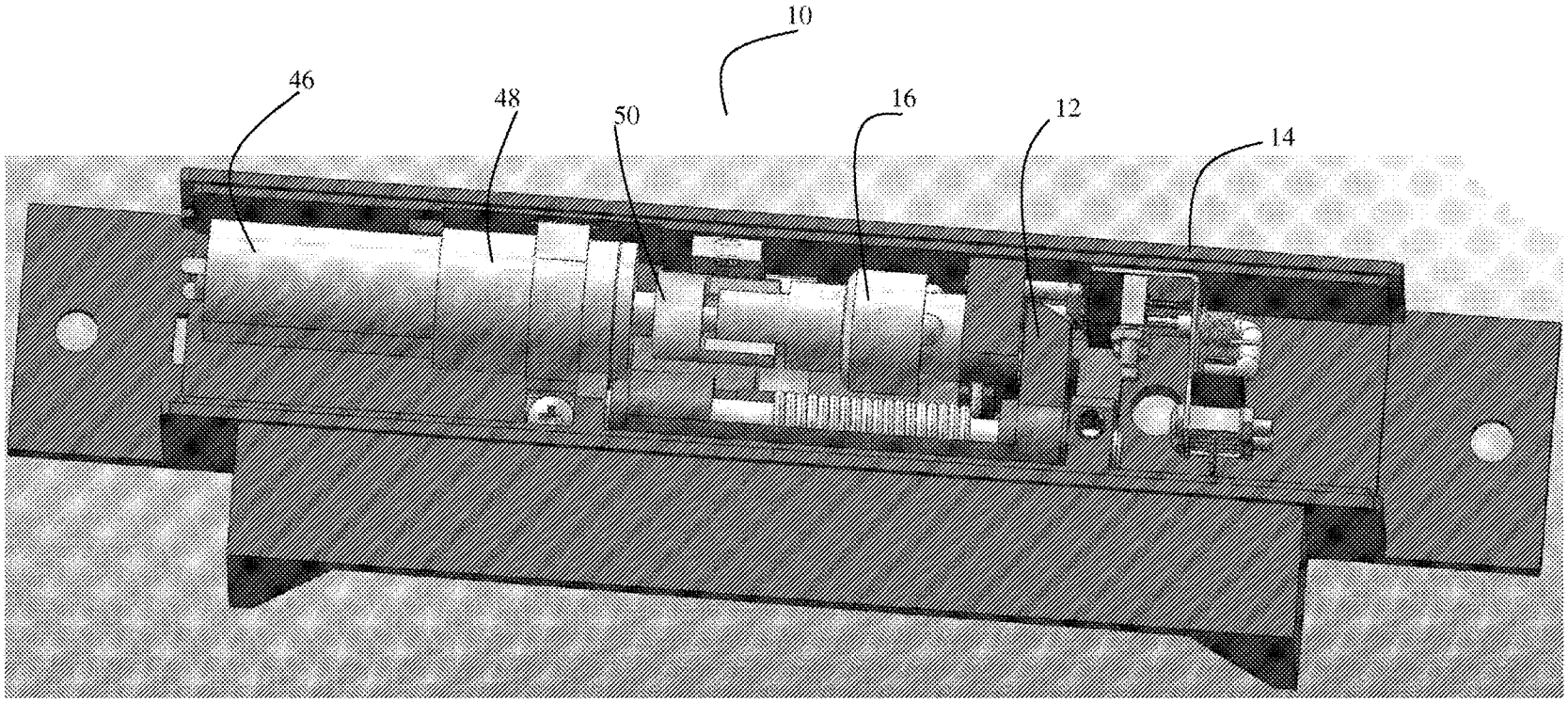
FIG. 2 is a rear perspective view of an electric strike incorporating the locking mechanism of FIG. 1.

Referring to FIG. 2, an electric strike 10 is shown including the locking mechanism 16 of FIG. 1. Strike 10 includes a keeper 12 and a housing 14. Keeper 12 is pivotally mounted to housing and is moveable between a closed position as seen in FIG. 1 to an open position, as is well known in the art. In the closed position the keeper retains a latch of a mechanical door lock (not shown). Locking mechanism 16 controls whether the strike is in a locked or unlocked condition depending upon whether plunger 20 is free to move inwardly of cage 26, as will now be described.

Figure 3:
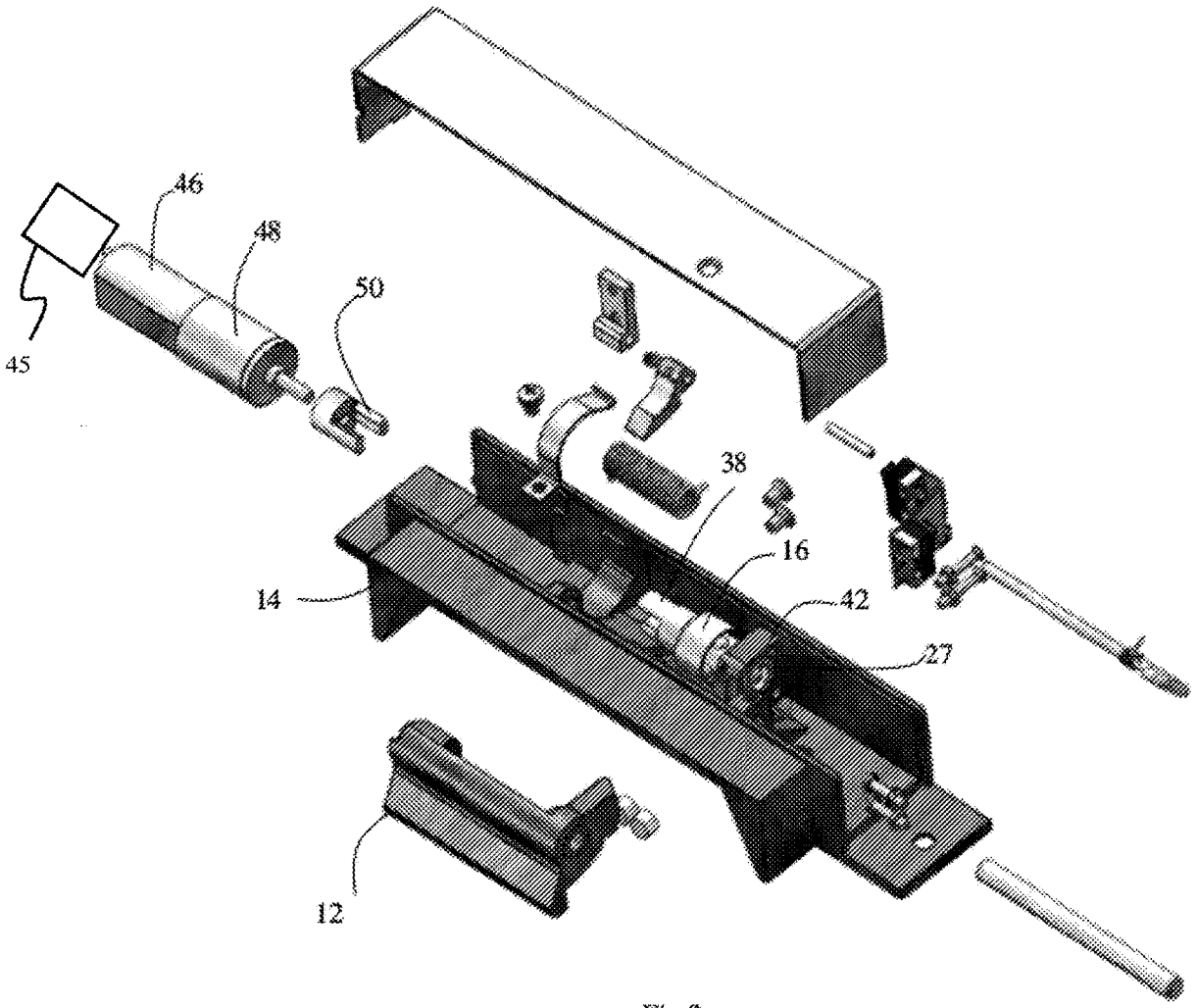
FIG. 3 is an exploded perspective view of the electric strike of FIG. 2.

Referring to FIG. 3, locking mechanism 16 is mounted in housing 14 by way of inserting cage 26 into aperture 42 from the right hand side, as shown in the figure. Mounting flange 27 limits the depth of insertion of cage 26 and prevents movement of cage 26 to the left, as shown in the drawings.

A motor 46 and gearbox 48 arrangement is used to rotate sleeve 24. The output shaft of gearbox 48 carries a second dog 50 which engages with dog 38 of sleeve 24. The dogs 50, 38 are arranged in a sliding fit with one another. As will be seen, dog 50 remains in a laterally fixed position within the housing 14 on the end of the output shaft of gearbox 48, whereas sleeve 24 moves linearly to the left and to the right as sleeve 24 rotates by interaction of screw threads 30 and 31. The dogs 50, 38 accommodate the linear movement of the sleeve to maintain rotational control of sleeve 24 by the motor 46 and gearbox 48 combination.

Figure 4:
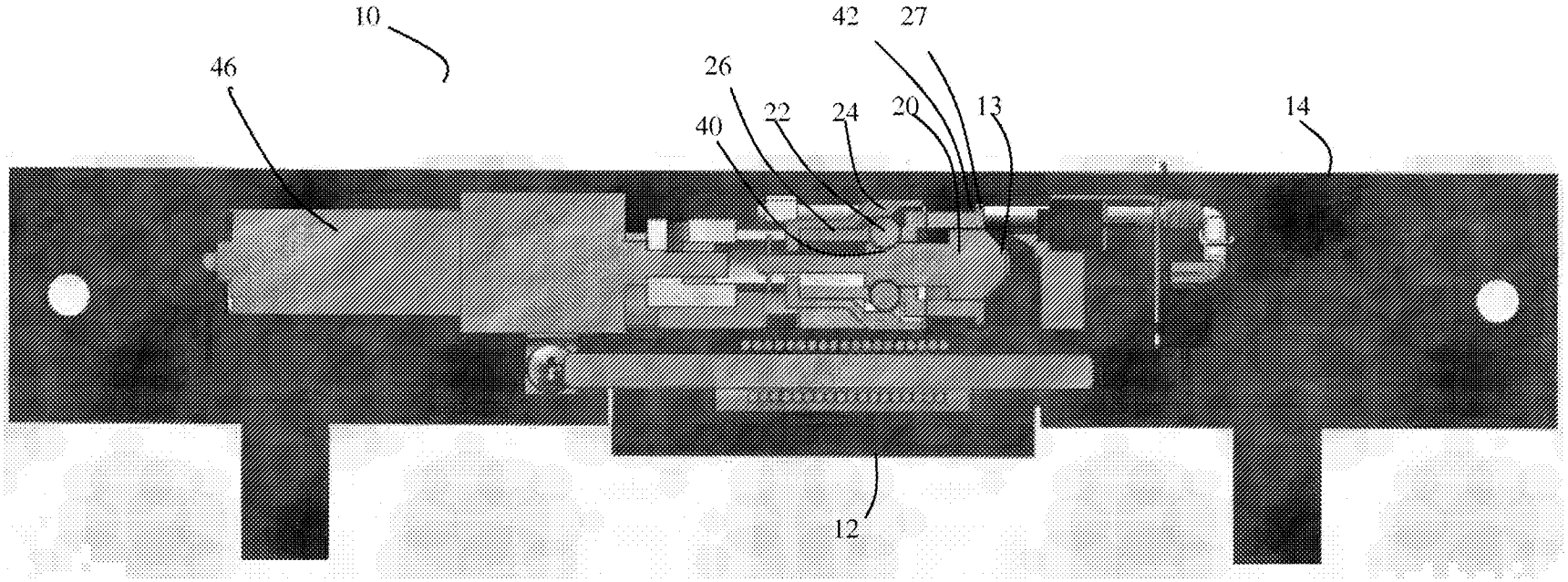
FIGS. 4 to 6 are cross sectional views of the strike of FIG. 2 illustrating switching from the locked condition to the unlocked condition whilst under pre-load.

Referring to FIG. 4, the strike is shown in cross sectional view in the locked and closed position. It can be seen that plunger 20 includes a tapered end, which is lying in a correspondingly tapered recess 13 in keeper 12. If a force is applied to keeper 12 to move the keeper to the open position, then this force is translated to urge the plunger to move linearly to the left in the drawings by interaction of the tapered plunger 20 and tapered recess 13.

As can be seen from FIG. 4, the balls 22 are engaged with recess 40 of plunger 20 to prevent movement of plunger 20. The balls are retained in engagement with recess 40 by being surrounded by sleeve 24. The engagement of the balls 22 with recess 40 prevents movement of plunger 20, and therefore the strike is in a locked condition. Load applied to the keeper is transmitted to the plunger and is resisted by the balls 22 being restrained from moving outwardly by sleeve 24, and being restrained from moving to the left by apertures 28 of cage 26. It is to be noted that cage 26 cannot move to the left (as seen in the drawings) by way of engagement of flange 27 with aperture 42. Therefore, load applied to the keeper when in a locked state is borne by cage 26 in a lateral direction and radially by sleeve 24.

Figure 5:
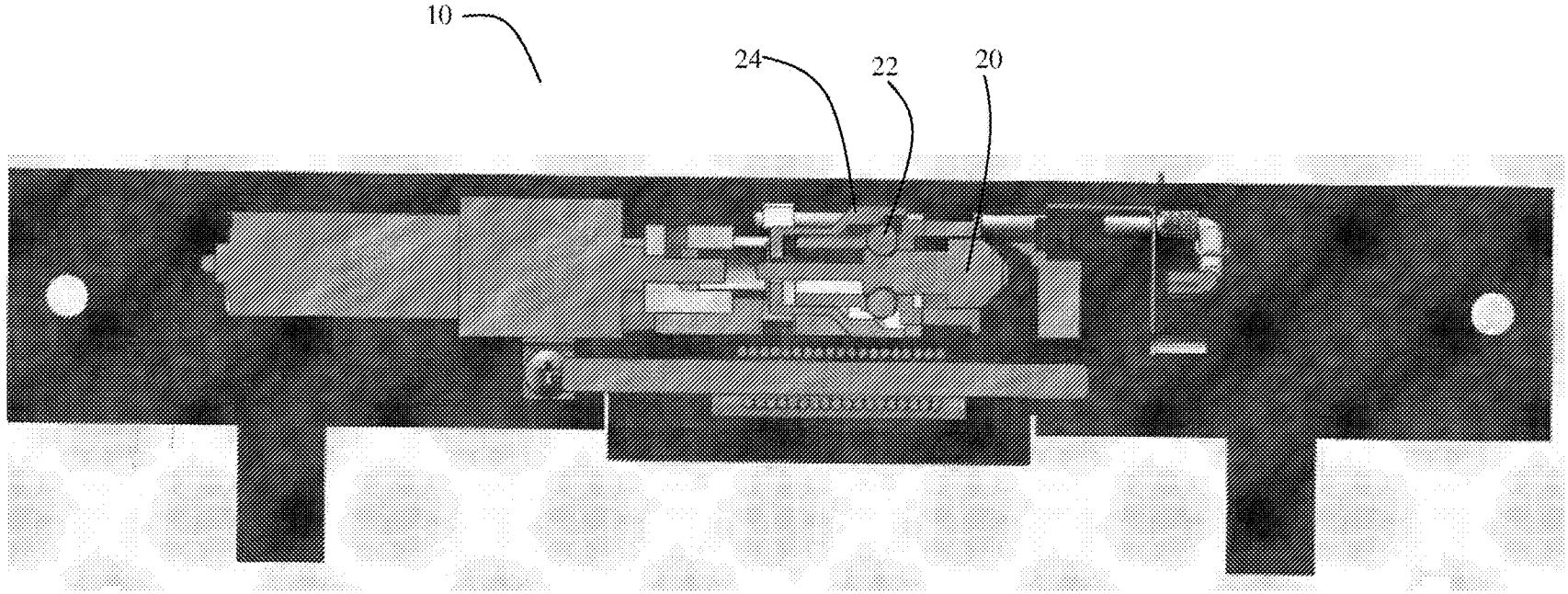
Figure 6:
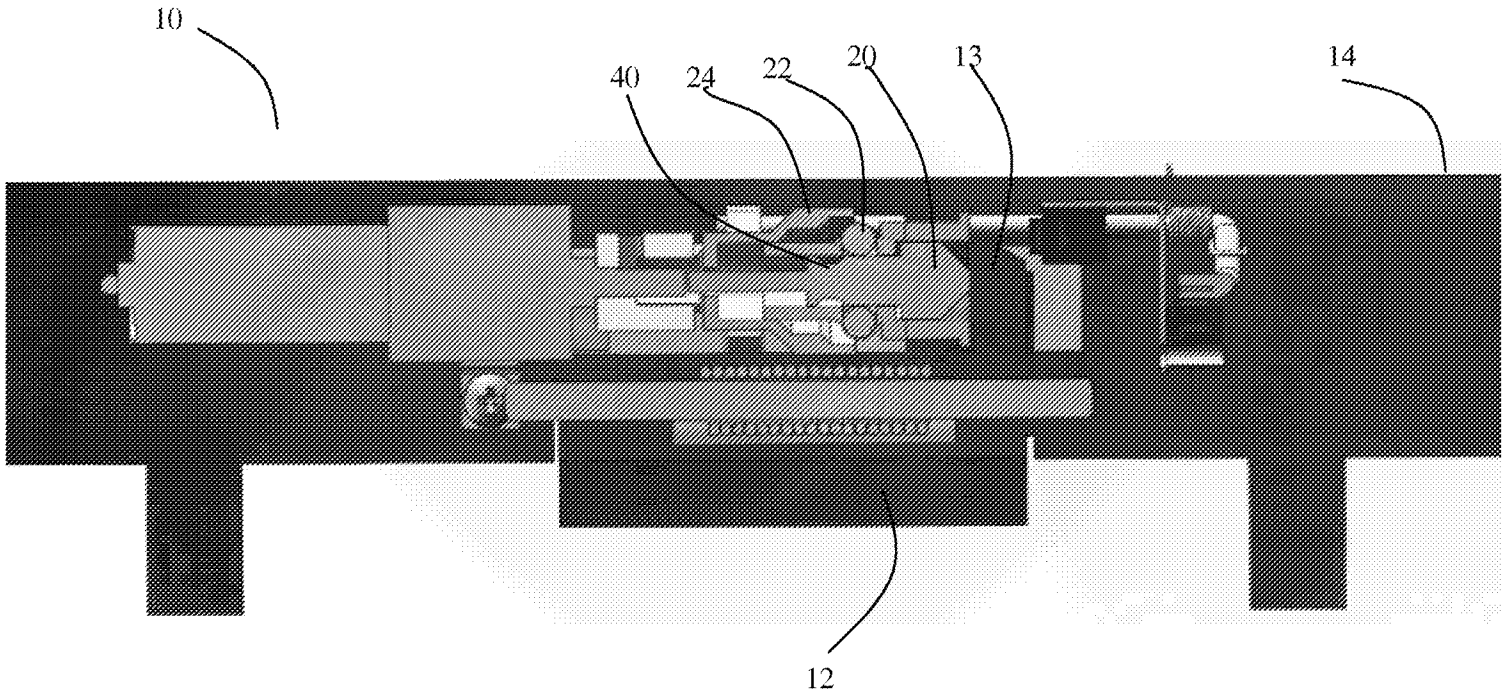

Operation of the strike to move from the locked condition to the unlocked condition is illustrated by the sequence shown in FIGS. 4 to 6. Referring to FIG. 5, with load applied to the keeper 12, lock has received a signal to move to the unlocked condition. Motor 46 has been activated to rotate sleeve 24 to cause it to move to the left in the drawings by way of rotating on screw thread 30. There is a frictional force between balls 22 and the inside surface of sleeve 24 due to the plunger 20 urging the balls 22 radially outwardly. However, motor 46 and gearbox combination 46, 48 provides sufficient rotational force to overcome this. Furthermore, the sleeve 24 and balls 22 are formed from stainless steel with a smooth surface finish to minimize these frictional forces. In FIG. 5, the balls 22 are almost at the point where they are free to move radially outwardly and out of engagement with recess 40.

Referring to FIG. 6, the sleeve 24 has continued to rotate and has moved further to the left, and the strike is now in the unlocked condition. Balls 22 are no longer retained by sleeve 24. The balls 22 have moved outwardly to come out of engagement with recess 40, and plunger 20 has moved to the left, coming out of engagement with recess 13 as keeper 12 has rotated to the open position, thereby releasing a door latch.

Strike includes an on-board controller board or onboard power source 45 which provides power to the motor 46 to control the motor. The polarity of the power applied to the motor dictates whether the motor moves in a clockwise or anti-clockwise direction. The controller board senses when the sleeve is in the locked position by way of microswitch 13 which is actuated by the sleeve acting on pushrod 15. In other embodiments, the controller board may detect that the motor has reached the end of its stroke by the fact that, when unable to move further, the motor draws more current. This increase in current can be used to assume that the sleeve has reached a desired position. In other embodiments optical sensors or Hall effect sensors are used to sense the position of the sleeve.

Lock 10 can operate in two modes, Fail Safe and Fail Secure. In the Fail Secure mode, in the event of a power cut to the lock, the lock remains in the locked position. In the Fail Safe mode, if power to the lock is cut, then the lock moves to the unlocked position (FIG. 6). The Fail Safe mode requires an on board power supply such as a battery, capacitor or super capacitor. In the event of a power cut, the on board power supply is used to power the motor. The lock is switched between modes by way of a jumper or dip-switch provided on the controller PCB of the electric strike (not shown). The change of direction Fail Safe/Fail Secure can be made by either a manual function or electronically by means of reversing polarity on any form of electrical storage device, such as batteries or super capacitors.

An alternative embodiment of a locking mechanism 116 and electric strike 110 will be described with reference to FIGS. 7 to 13. Parts corresponding to those seen in locking mechanism 16 will be indicated by like reference numerals prefixed by the number "1". Identical parts to those used in locking device 16 will be indicated by the same reference numbers. The major difference in locking device 116 is that the sleeve rotates through only 45 degrees to move between the locked and unlocked conditions.

Figure 7:
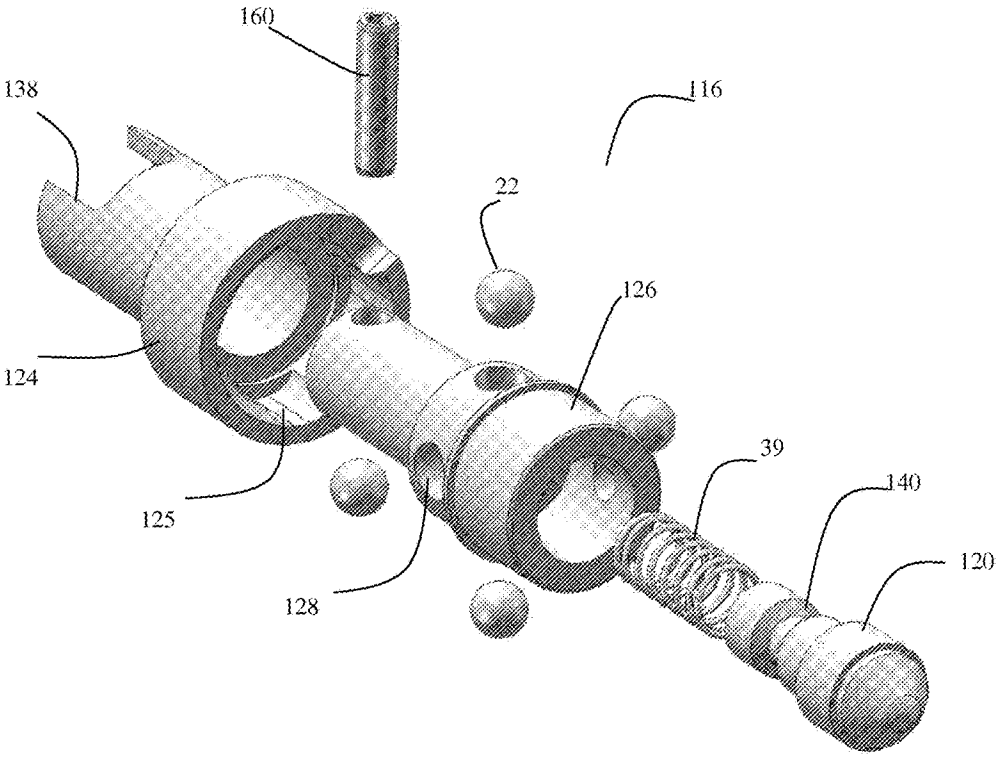
FIG. 7 is an exploded perspective view of another embodiment of a locking mechanism.

Referring to FIG. 7, a locking mechanism is shown including a sleeve 124, a cage 126 and a plunger 120. Cage 126 includes four apertures 128 in which are located locking elements in the form of balls 22. Sleeve 124 includes a series of four recesses 125 provided about its inside surface. When assembled, retaining pin 160 maintains sleeve 124 engaged to cage 126, and also serves to limit to the rotation of sleeve 124 with respect to cage 126 by engaging with arms of dog 138.

Figure 8:
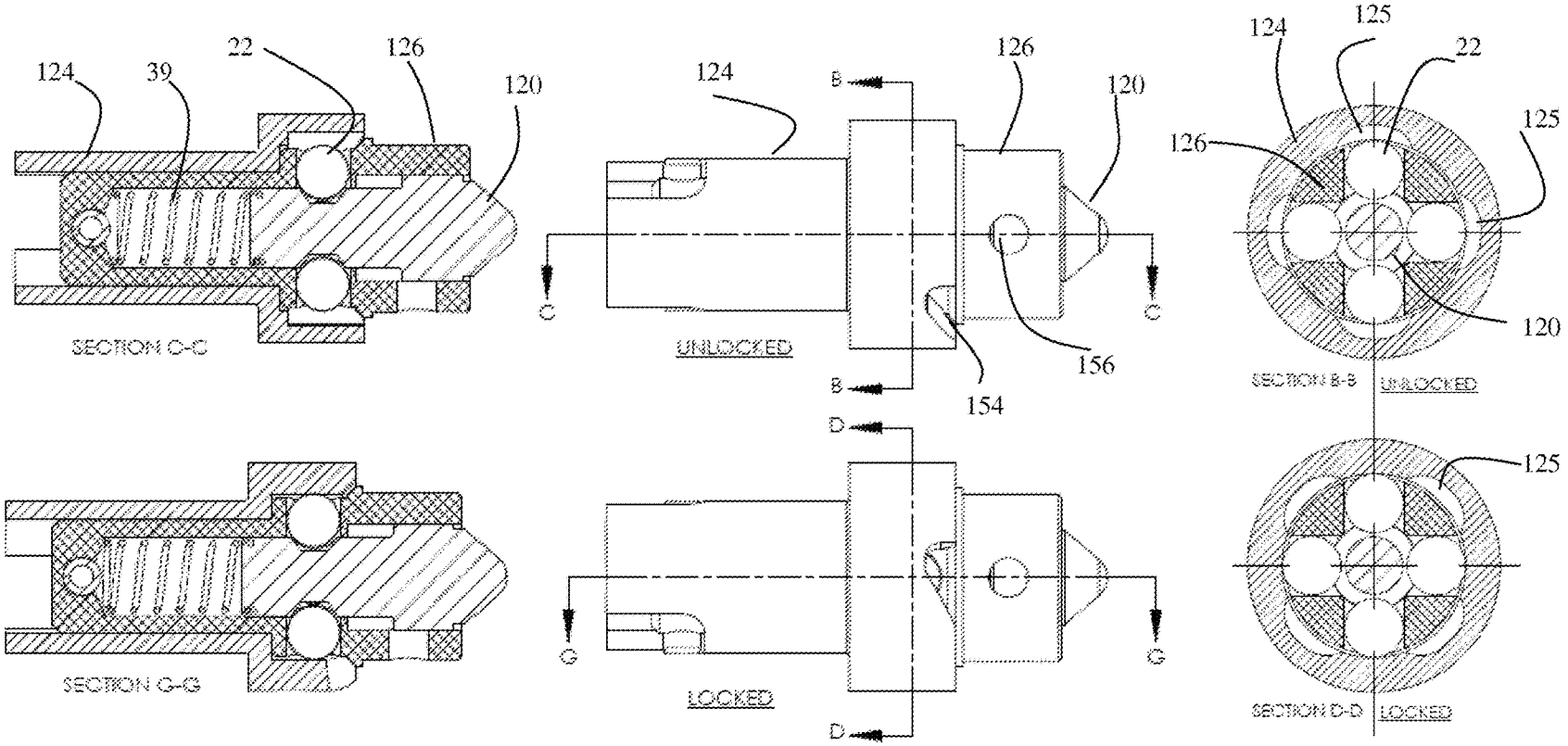
FIG. 8 illustrates additional views of the locking mechanism of FIG. 7.

Referring to FIG. 8, as best seen at section B-B, when the sleeve 124 is in the unlocked position, recesses 125 align with the positions of balls 22. In this position, plunger 120 may be pushed inwardly as balls 22 are free to move outwardly to enter recesses 125.

To move to the locked position, sleeve 124 is rotated by 45 degrees. As best seen in section D-D, balls 22 are now prevented from moving outwardly, but are retained by sleeve 124 in engagement with recess 140 of plunger 120. In this position, plunger 120 cannot be pushed inwards.

Figure 9:
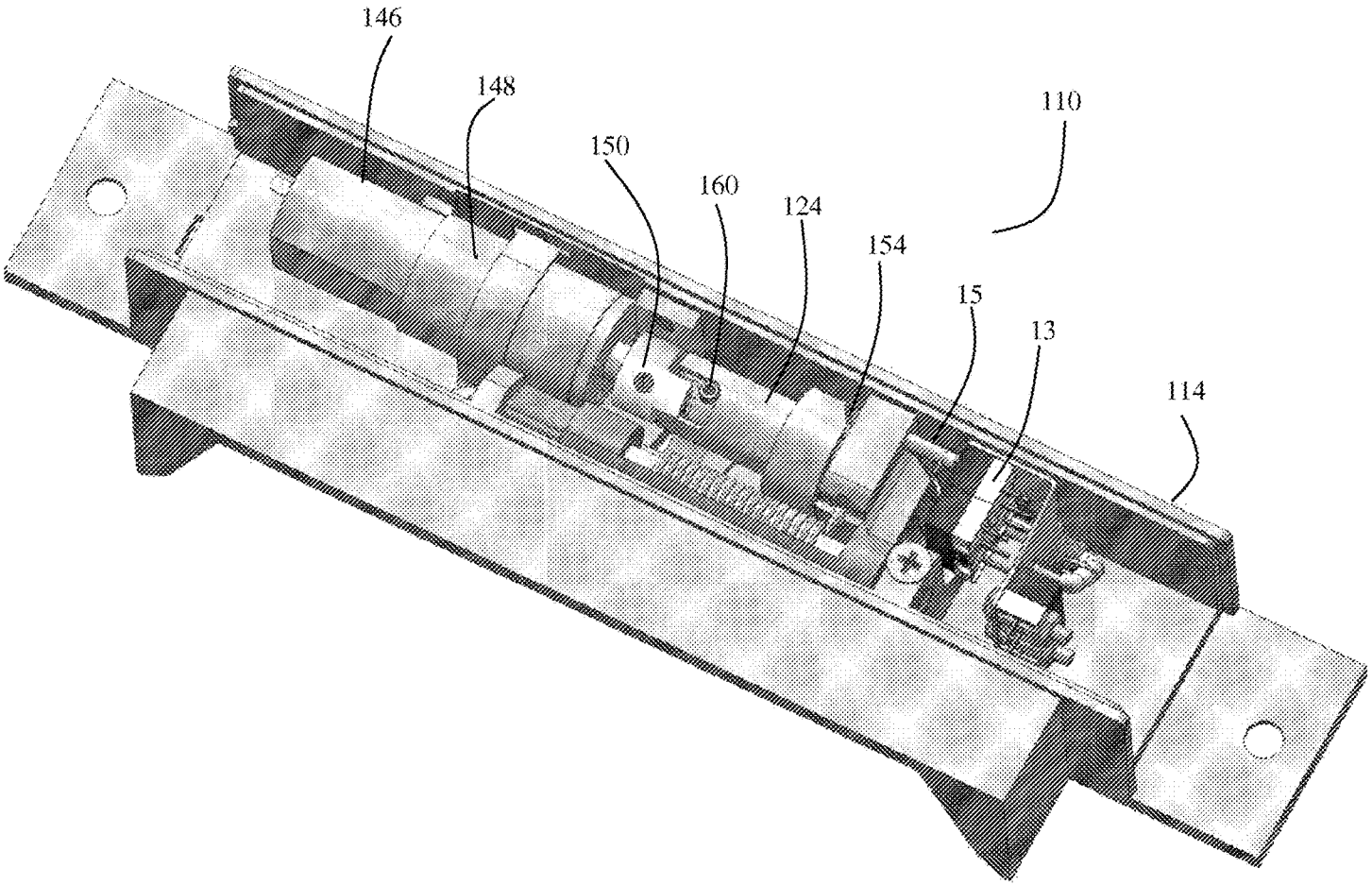
FIGS. 9 and 10 illustrate the locking mechanism of FIG. 7 incorporated into an electric strike.
Figure 10:
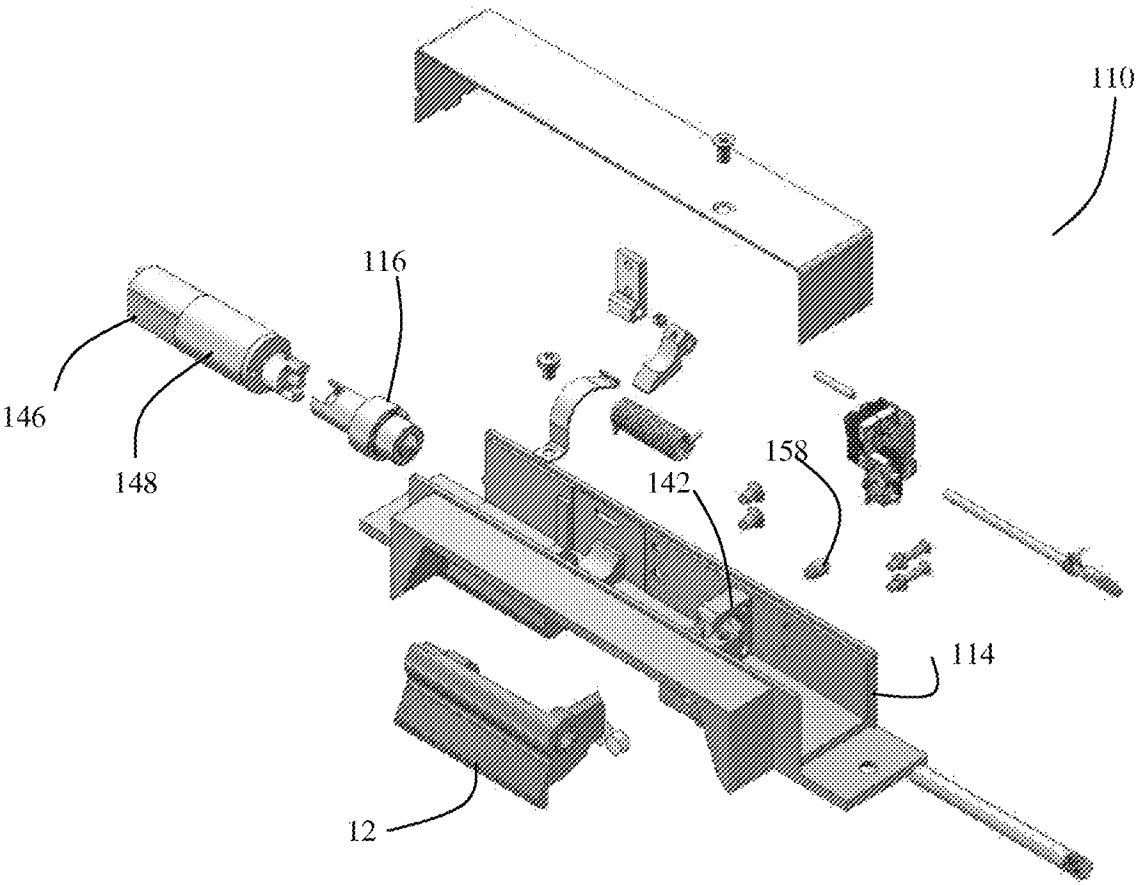

Referring to FIGS. 9 and 10, locking mechanism 116 fits to housing 114 by being inserted into aperture 142 from the left side as seen in the figures, and is secured by set screw 158 engaging with aperture 156 (see FIG. 8).

Sleeve 124 is arranged to be rotated by way of a motor 146 and gearbox 148 combination which engages with sleeve 124 by way of dog 150.

A ramp 154 provided on the end of sleeve 124 actuates pushrod 15 to depress microswitch 13, thus enabling remote monitoring of whether the strike 110 is in a locked condition.

Figure 11:
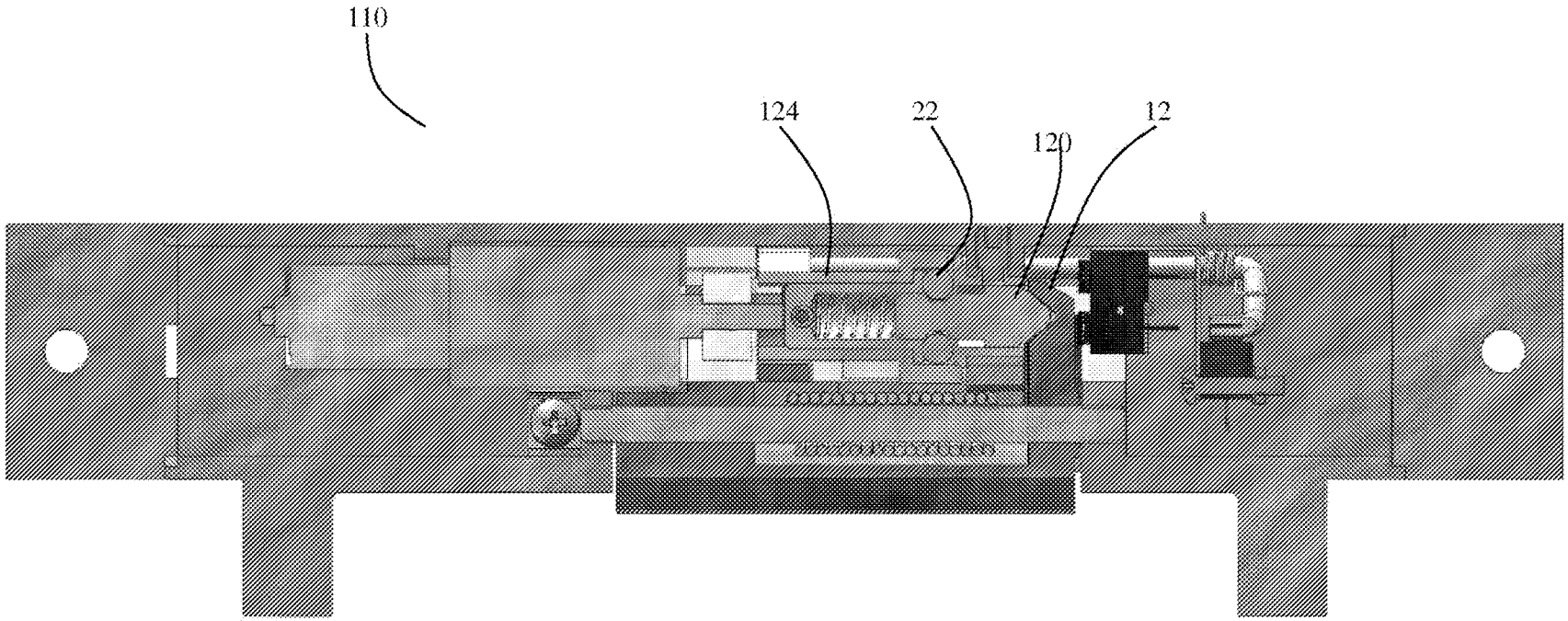
FIGS. 11 to 13 depict a sequence of operation of the electric strike of FIG. 9.
Figure 12:
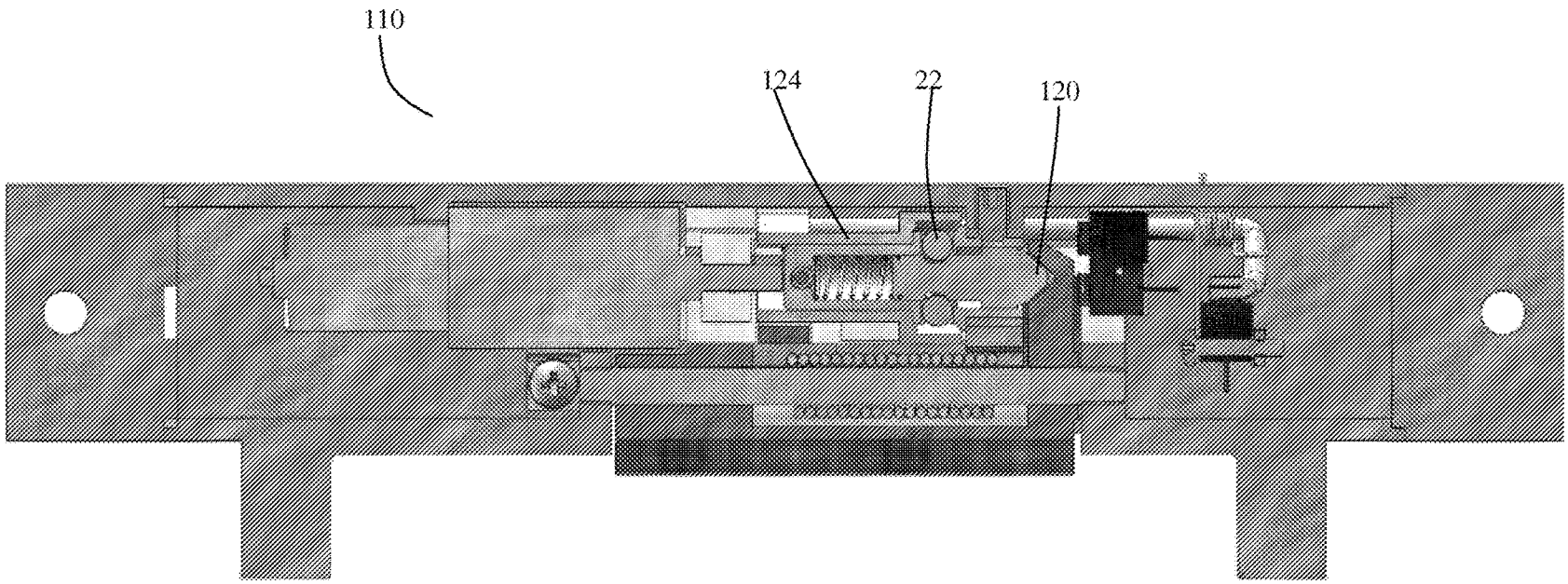
Figure 13:
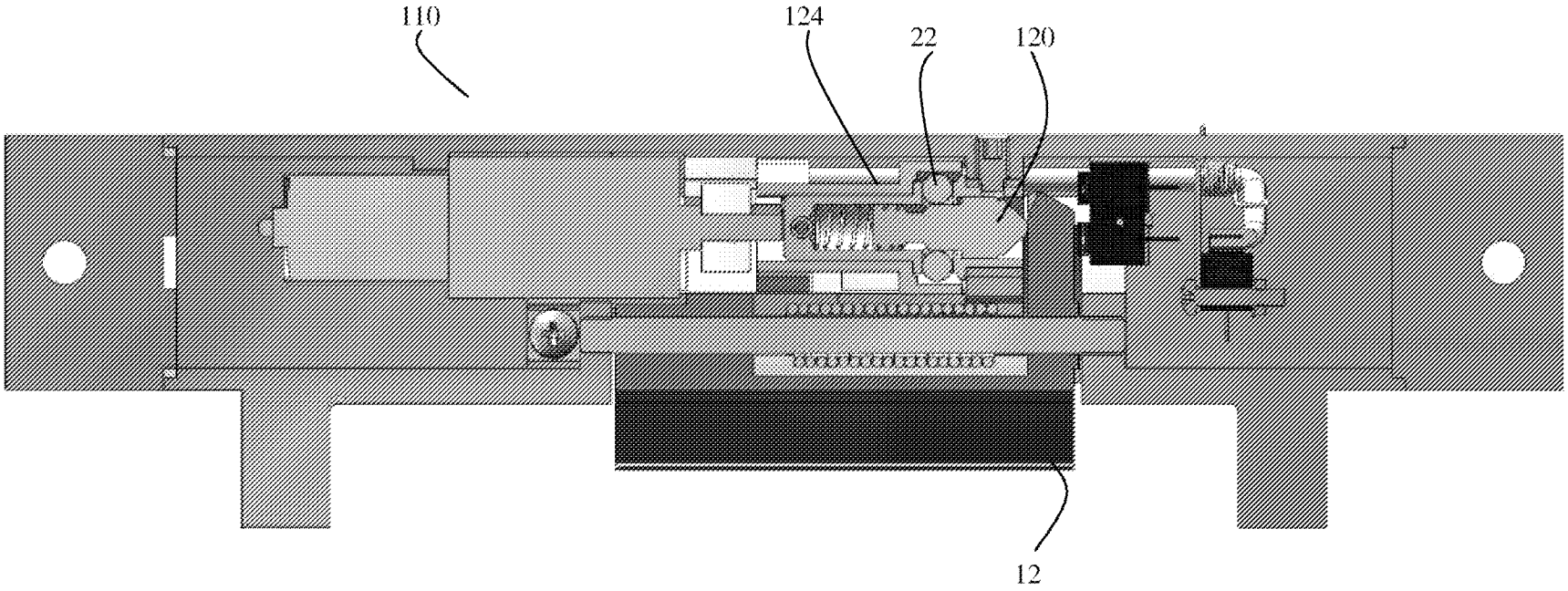

The sequence of operation of the strike 110 moving from the locked to the unlocked and open conditions is shown in FIGS. 11 to 13. In FIG. 11, sleeve 124 is in the locked position. Plunger 120 is prevented from being pushed into cage 126 by way of balls 22 engaging with recess 140 of plunger 120, and therefore keeper 12 is maintained in the closed position.

In FIG. 12, sleeve 124 has been rotated through 45 degrees so that the recesses 125 align with balls 22.

In FIG. 13, keeper 12 has rotated to the open position, pushing plunger 120 inwardly of cage 126.

It has been found that locking mechanisms according to embodiments of the invention have excellent operating characteristics under pre-load conditions. That is, the sleeve of the locking mechanism can be moved with respect to the cage even whilst a considerable force is simultaneously being applied to the plunger of the mechanism.

Whilst the above described embodiment utilizes a motor and gearbox to drive the lock mechanism, in other embodiments, a motor could be used without a gearbox. As a further alternative, the mechanism can be driven by a solenoid.

Whilst the locking mechanism has been described with reference to use in a locking device in the form of an electric strike, it can similarly be used in locks of other types including gate locks, drop bolts and electric mortise locks.

It can be seen that embodiments of the invention have at least one of the following advantages.

The locking mechanism has excellent pre-load characteristics.

In the event of loss of power, the lock can be moved to its unlocked condition using on board power supply.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

What is claimed is:

1. An electric strike, comprising:

a housing;

a rotary motor positioned in the housing, the rotary motor having an output shaft;

a sleeve comprising a plurality of recesses, wherein the sleeve is structured to move between a locked position and an unlocked position in response to rotation of the output shaft;

a cage seated in the sleeve, the cage comprising a plurality of apertures;

a plurality of locking elements, wherein each of the locking elements is movably seated in a corresponding one of the apertures;

a plunger movably seated in the cage, the plunger comprising a recessed portion and a ramp, the plunger having an extended position in which the recessed portion is aligned with the plurality of apertures and is operable to receive the plurality of locking elements, and a retracted position in which the recessed portion is misaligned with the plurality of apertures, wherein the ramp is structured to urge the locking elements radially outward in response to movement of the plunger from the extended position toward the retracted position;

a keeper pivotally mounted to the housing, the keeper having a closed position and an open position, wherein the keeper comprises a formation structured to urge the plunger from the extended position toward the retracted position in response to pivoting of the keeper from the closed position toward the open position;

wherein, with the sleeve in the locked position, the recesses are misaligned with the apertures and the sleeve prevents radially outward movement of the locking elements, thereby preventing movement of the plunger from the extended position to the retracted position, thereby preventing the movement of the keeper from the closed position to the open position; and wherein, with the sleeve in the unlocked position, the recesses are aligned with the apertures and the recesses enable radially outward movement of the locking elements, thereby enabling movement of the plunger from the extended position to the retracted position, thereby enabling movement of the keeper from the closed position to the open position.

2. The electric strike of claim 1, wherein the output shaft is rotationally engaged with the sleeve, and the sleeve is structured to rotate between the locked position and the unlocked position in response to rotation of the output shaft.

3. The electric strike of claim 1, wherein the movement of the sleeve between the locked position and the unlocked position in response to rotation of the output shaft is rotational movement.

4. The electric strike of claim 3, wherein the sleeve further comprises a dog, wherein a protrusion extends from the cage and into the dog, and wherein engagement between the dog and the protrusion limit rotation of the sleeve with respect to the cage.

5. The electric strike of claim 1, wherein the rotary motor is operable to receive power from an external power source, wherein the electric strike further comprises an energy storage device, and wherein the energy storage device is structured to supply energy to the rotary motor in response to failure of the external power source.

6. The electric strike of claim 1, wherein each of the locking elements comprises a ball.

7. The electric strike of claim 1, further comprising a spring, wherein the plunger is biased toward the extended position by the spring.

8. The electric strike of claim 1, wherein the formation of the keeper comprises a tapered recess, and the plunger further comprises a tapered nose operable to engage the tapered recess.

9. An electric strike, comprising:

a housing;

a keeper pivotally mounted in the housing, the keeper having a closed position and an open position;

a plunger comprising a nose operable to engage a formation on the keeper, and a stem including a recessed portion;

a cage having a plurality of apertures, wherein the plunger is movably seated in the cage and has an extended position in which the recessed portion is aligned with the plurality of apertures and a retracted position in which the recessed portion is misaligned with the plurality of apertures;

a plurality of locking elements, wherein each of the locking elements is movably seated in a corresponding one of the apertures and is operable to engage the recessed portion of the stem when the plunger is in the extended position;

a sleeve comprising a plurality of recesses, the sleeve having an unlocked position in which the recesses are aligned with the apertures and the locking elements, and a locked position in which the recesses are misaligned with the apertures; and an actuator operable to move the sleeve between the locked position and the unlocked position;

wherein the nose of the plunger and the formation of the keeper are structured to urge the plunger from the extended position toward the retracted position in response to movement of the keeper from the closed position toward the open position;

wherein, in the locked position, the sleeve maintains the locking elements in engagement with the recess on the plunger, thereby preventing movement of the plunger, and thereby preventing movement of the keeper from the closed position to the open position;

wherein, in the unlocked position, the sleeve releases the engagement of the locking elements with the recess on the plunger, thereby allowing movement of the plunger, and thereby allowing the keeper to move from the closed position to the open position.

10. The electric strike of claim 9, wherein the actuator comprises an electric motor, and wherein the electric motor is operable to rotate the sleeve between the locked position and the unlocked position.

11. The electric strike of claim 10, wherein the actuator further comprises a gearbox connected between the electric motor and the sleeve.

12. The electric strike of claim 9, wherein the cage includes a flange engaged with the housing, and wherein engagement of the flange and the housing restricts movement of the cage with respect to the housing.

13. An electric strike, comprising:

a housing;

a keeper pivotally mounted in the housing, the keeper having a closed position and an open position;

a plunger cooperating with a formation on the keeper, the plunger having an extended position and a retracted position, wherein the plunger comprises a recess, and wherein movement of the keeper from the closed position to the open position causes movement of the plunger from the extended position to the retracted position through the cooperation of the plunger with the formation on the keeper;

a cage having a plurality of apertures, wherein the recess is aligned with the apertures when the plunger is in the extended position, and wherein the recess is misaligned with the apertures when the plunger is in the retracted position;

a plurality of locking elements movably seated in the apertures;

a sleeve at least partially surrounding the cage, wherein the sleeve has a locking position in which the sleeve maintains the locking elements in engagement with the recess on the plunger, thereby maintaining the plunger in the extended position and preventing movement of the keeper from the closed position to the open position, and wherein the sleeve has an unlocking position in which the sleeve releases the engagement of the locking elements with the recess on the plunger, thereby allowing movement of the plunger to the retracted position and allowing the keeper to move from the closed position to the open position;

a motor structured to move the sleeve from the locking position to the unlocking position in response to an unlocking signal and to move the sleeve from the unlocking position to the locking position in response to a locking signal; and a controller in communication with the motor, wherein the controller includes an onboard power source and is structured for connection to an external power source, wherein the controller, in response to failure of the external power source, uses power from the onboard power source to provide the motor with one of the locking signal and the unlocking signal.

14. The electric strike of claim 13, wherein the controller is selectively operable in each of a fail secure mode.

15. The electric strike of claim 14, further comprising a dip switch in communication with the controller, wherein the controller is configured to operate in the fail secure mode in response to a first position of the dip switch and to operate in the fail safe mode in response to a second position of the dip switch.

16. The electric strike of claim 14, wherein the onboard power source comprises a capacitor.

17. The electric strike of claim 13, wherein the motor is structured to rotate the sleeve in a first direction in response to the unlocking signal and to rotate the sleeve in an opposite second direction in response to the locking signal.

* * * * *